United States Patent [19]

Grunden et al.

[11] Patent Number: 4,955,806

[45] Date of Patent: Sep. 11, 1990

[54] INTEGRATED FURNACE CONTROL HAVING IGNITION SWITCH DIAGNOSTICS

[75] Inventors: Michael T. Grunden; Stephen E. Youtz; Eugene P. Mierzwinski, all of Fort Wayne, Ind.

[73] Assignee: Hamilton Standard Controls, Inc., Farmington, Conn.

[21] Appl. No.: 349,296

[22] Filed: May 9, 1989

Related U.S. Application Data

[62] Division of Ser. No. 95,506, Sep. 10, 1987, Pat. No. 4,842,510.

[51] Int. Cl.[5] ..... F23N 5/00

[52] U.S. Cl. ..... 431/24; 431/25; 431/69; 431/78; 340/579

[58] Field of Search ..... 431/25, 69, 75, 78, 431/24; 340/579; 328/6

[56] References Cited

U.S. PATENT DOCUMENTS

| | | | |
|---|---|---|---|
| 3,576,556 | 4/1971 | Sellers, Jr. | 340/579 |
| 3,781,161 | 12/1973 | Schuss | 431/16 |
| 4,243,372 | 1/1981 | Cade | 431/78 X |
| 4,295,129 | 10/1981 | Cade | 110/193 X |
| 4,402,663 | 9/1983 | Romanelli et al. | 431/71 X |
| 4,444,551 | 4/1984 | Mueller et al. | 431/66 X |
| 4,662,838 | 5/1987 | Riordan | 431/25 |
| 4,672,324 | 6/1987 | van Kampen | 431/25 X |

*Primary Examiner*—Carl D. Price

[57] ABSTRACT

An integrated electronic control arrangement is disclosed in the illustrative environment of burner such as in a gas-fired furnace. The control incorporates a self-test feature which shuts down the furnace in the event of any one of a number of possible sensed faults. Self-testing occurs automatically before an attempt at ignition and during furnace operation. Proper functioning of the sensor which senses for induced air flow through the burner combustion chamber is tested prior to enabling a fan which causes that induced air flow. Air flow is confirmed by sending to and receiving back from the sensor a sequence of pulses. Should air flow not be sensed during a combustion period, combustion is terminated. A flame sensor is provided for determining the presence of a flame in the combustion chamber. During times when a flame should be present, pulse sequences are sent to and received back from the flame sensor to confirm that a flame is present. When it is known that no flame is present, if sent pulses are received back, a fault has occurred and the system locks out. If, at any time, any pulses are received when none were sent the system also locks out.

4 Claims, 11 Drawing Sheets

INTEGRATED FURNACE CONTROL HAVING IGNITION SWITCH DIAGNOSTICS

This is a division of application Ser. No. 095,506 filed on Sept. 10, 1987 now U.S. Pat. No. 4,842,510.

SUMMARY OF THE INVENTION

The present invention relates generally to electronic controls for burners, furnaces and the like, and more particularly to an integrated control for such burners in the illustrative environment of a gas-fired furnace.

Older furnace control systems have taken a modular approach with separate controls for functions such as gas ignition, a blower fan, the gas valve or valves, induced draft sensing, and thermostat setback operations. The integrated furnace control has taken many of the furnace control functions and combined them into one main control module and may also include such features as a thermostat setback function. The combining of all these functions into one complete module has made the system more cost effective than using separate components, allows many additional features, and provides a safer control.

Integrated furnace control units, or units having at least some of the attributes of integrated control systems have also been known for some time. Illustrative of these known arrangements are the following U.S. Patents. U.S. Pat. No. 4,402,663 which provides for the detection of a flameout or low gas line pressure and suggests indicating the status of other possible malfunctions within the system. U.S. Pat. No. 3,781,161 which pretests a plurality of components by mimicing the start-up and shut-down processes. U.S. Pat. No. 4,444,551 which provides for a flame detector and light emitting diodes for visual indicators of a malfunction. This patented arrangement also allows three retrys or attempts at ignition and then shuts the system down. U.S. Pat. No. 4,295,129 which monitors main and pilot fuel flows and shuts down in response to an abnormal condition. U.S. Pat. No. 3,576,556 which discloses a flame detector circuit along with circuitry for pretesting the detector circuitry for component malfunctions. Finally, U.S. Pat. No. 4,243,372 teaches an arrangement for checking to see that an air flow sensor is operating properly as well as a purge cycle to clear the combustion chamber of accumulated gas prior to an ignition attempt. The air flow sensor in this patented arrangement has a single set of contacts which are checked to see that they are open immediately upon energization of the fan and prior to the air flow being established.

These prior attempts to integrate furnace control typically fail to adequately check for false information and, in particular, fail to combine testing of safety sensors for false indications both while the sensor should be detecting a particular burner parameter and when the sensor should not be sensing that parameter, and are generally wanting in versatility.

In copending application Ser. No. 095,508 assigned to the assignee of the present application, entitled INTEGRATED FURNACE CONTROL AND CONTROL SELF TEST in the names of Mierzwinski, Grunden and Youtz filed on even date herewith now U.S. Pat. No. 4,872,828, there is disclosed a companion integrated furnace control system sharing some features with that disclosed herein and the entire disclosure thereof is specifically incorporated herein by reference.

Among the several objects of the present invention may be noted the provision of a versatile and economical integrated furnace control system; the provision of a furnace control system which interrogates certain furnace components and checks for receipt back of a proper response; the provision of a furnace control system in accordance with the previous object which issues a safety interrupt and lockout command to preclude further furnace operation in a potentially unsafe manner in the event of either an improper response to the interrogation or the receipt of a response in the absence of any interrogation; and the provision of an integrated furnace control system which confirms proper operation of a variety of furnace components both prior to furnace ignition and during furnace operation. These as well as other objects and advantageous features of the present invention will be in part apparent and in part pointed out hereinafter.

In general, an integrated burner control for a gas burner of the type having at least one gas valve control relay operable upon command from the integrated burner control to open a gas valve and supply gas to a burner combustion chamber, an inducer fan for supplying air to the burner combustion chamber, and an air flow sensor for sensing air flow caused by operation of the inducer fan has an arrangement operable upon command for sending an interrogation signal to the air flow sensor. The sensor selectively provides a return signal to the integrated burner control indicative of the presence of adequate air flow or air pressure and the gas valve control relay is enabled only upon receipt of the return signal. The air pressure sensor is monitored during burner operation, and burner operation is interrupted and the gas valve closed upon an indication of inadequate air flow. In particular, the present inventive arrangement checks for a change in the state of the air sensing switch between the time before the inducer fan is enabled and after it is enabled, and will proceed with an attempt at ignition only if the appropriate change in state is sensed.

Also in general, and in one form of the invention, an integrated burner control for a gas burner of the type having at least one gas valve control relay operable upon command from the integrated burner control to open a gas valve and supply gas to a burner combustion chamber, and an inducer fan for supplying air to the burner combustion chamber has an air flow sensor for sensing air flow caused by operation of the inducer fan, the sensor having first contacts which are open when air flow is inadequate for proper burner operation and closed when the air flow is adequate, and second contacts which are open when the air flow is adequate and closed when the air flow is inadequate. The control includes an arrangement for sending a signal to the sensor and responsive to a reply signal from the sensor indicating the second contacts are closed for enabling the inducer fan preparatory to burner ignition.

Still further in general, an integrated burner control for a gas burner of the type having at least one gas valve control relay operable upon command from the integrated burner control to open a gas valve and supply gas to a burner combustion chamber has a flame sensor for sensing for the presence of a flame in the combusion chamber, and an arrangement for sending a sequence of pulses to the flame sensor and for receiving back from the flame sensor the same sequence of pulses indicating the presence of a flame. The arrangement is responsive to the reception from the flame sensor of a sequence of pulses in the absence of any sequence having been sent for providing a fault indication and precluding ignition attempts. The arrangement is also responsive to the sending of the sequence to the flame sensor and lack of reception back of the same sequence of pulses for disabling the gas valve control relay and closing the gas valve. The control is also adapted to send the sequence of pulses to the flame sensor when no flame is present and, in response to the reception from the flame sensor of a sequence of pulses, to provide a fault indication and preclude ignition attempts.

BRIEF DESCRIPTION OF THE DRAWING

Corresponding reference characters indicate corresponding parts throughout the several views of the drawing.

The exemplifications set out herein illustrate a preferred embodiment of the invention in one form thereof and such exemplifications are not to be construed as limiting the scope of the disclosure or the scope of the invention in any manner.

DESCRIPTION OF THE PREFERRED EMBODIMENT

Figure 2:
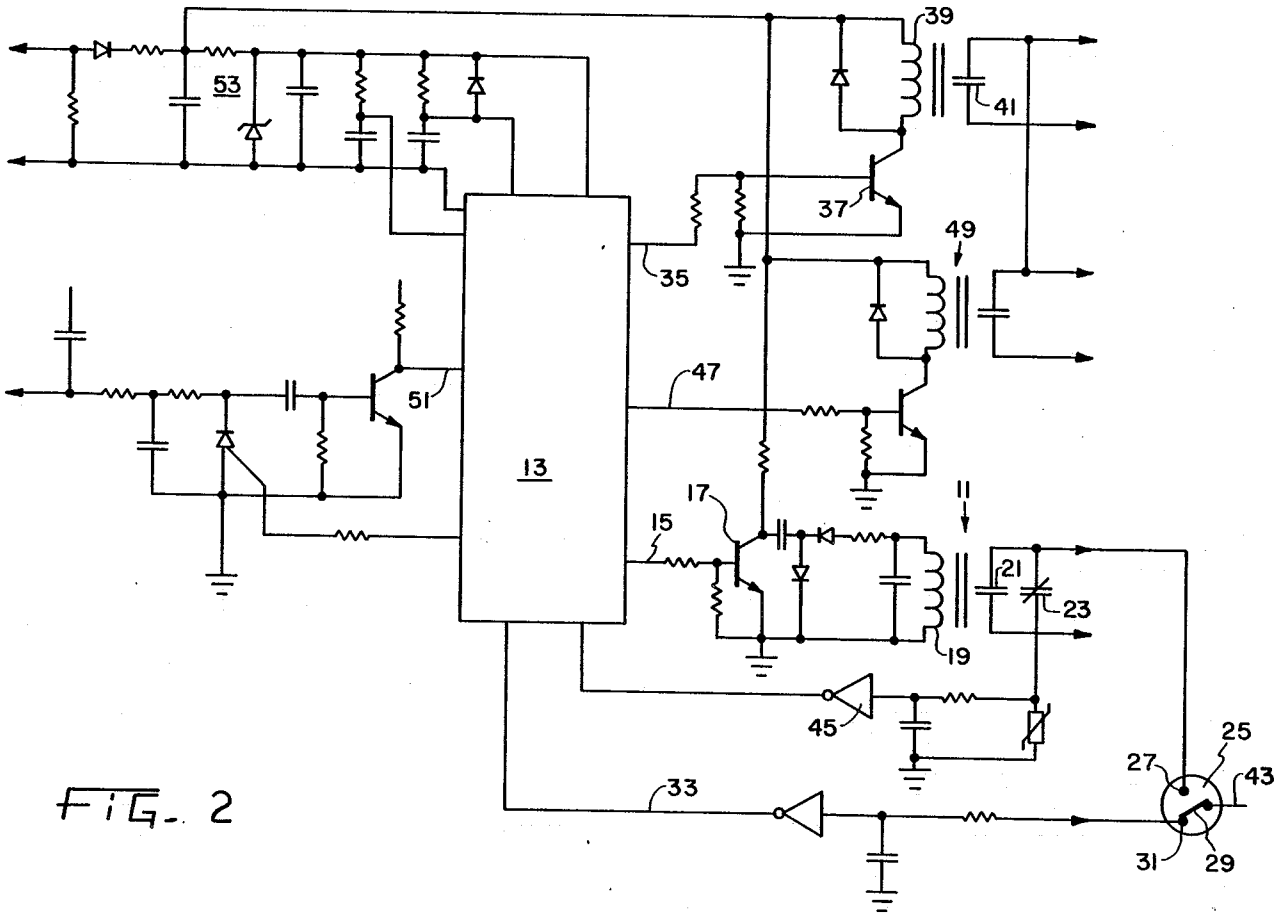
FIG. 2 is a schematic diagram illustrating a control according to one form of the invention.
Figure 3:
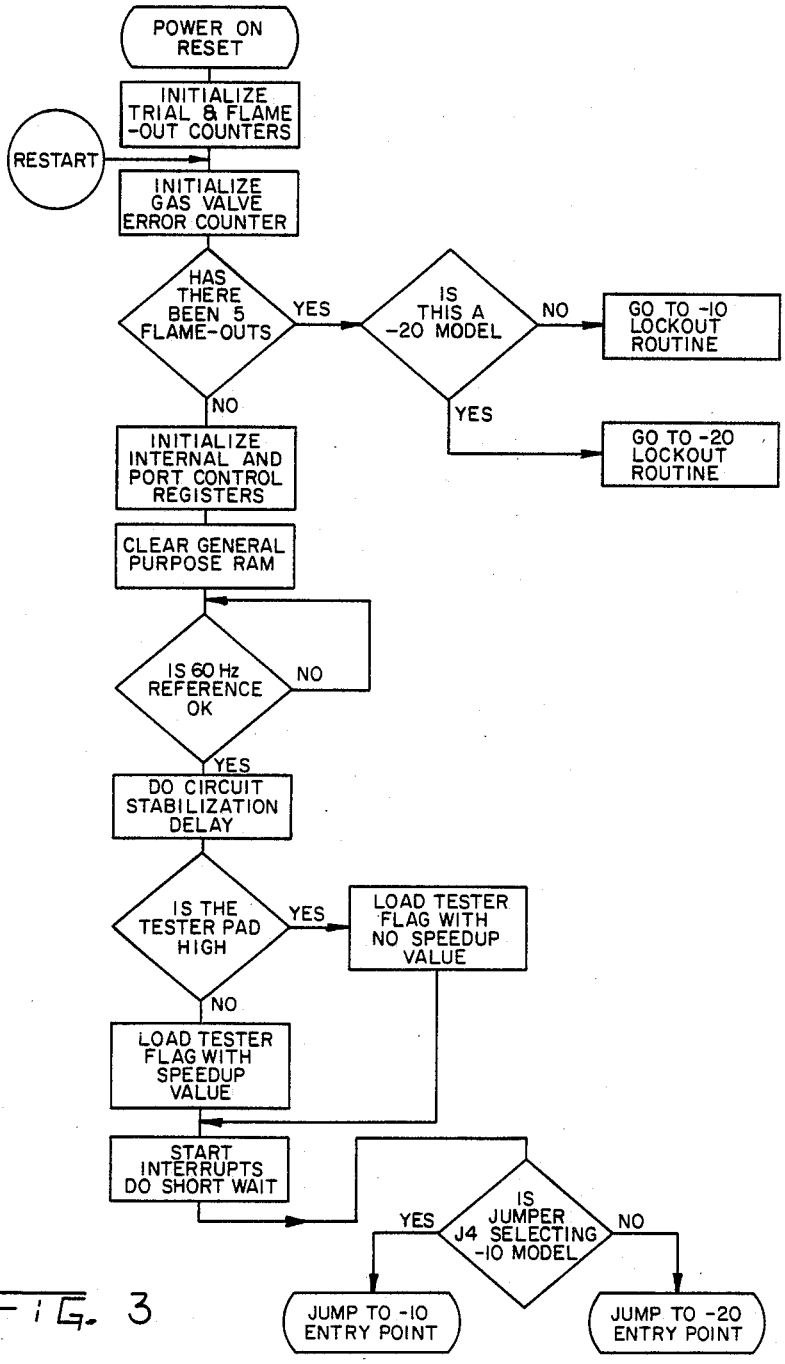
FIGS. 3–9 are system logic flow diagrams for the control systems of FIGS. 1 and 2.

Referring first to FIG. 2, an integrated burner control for a gas burner is illustrated. The system includes a gas valve control relay 11 which is operable upon command from the integrated burner control microprocessor 13 to open a gas valve and supply gas to a burner combustion chamber. The microprocessor issues a command to open the gas valve on line 15 which passes through driver transistor 17 to energize the relay coil 19 closing normally open contacts 21 and opening the normally closed contacts 23. The furnace or burner includes an inducer fan for supplying air to the burner combustion chamber and a pressure sensor of a conventional diaphragm type for sensing air flow caused by operation of the inducer fan. The sensor includes a switch 25 having first contacts 27 and 29 which are open when air flow is inadequate for proper burner operation and closed when the air flow is adequate, as well as second contacts 29 and 31 which are open when the air flow is adequate and closed when the air flow is inadequate. A signal in the form of the 24 volt alternating current for opening and closing the gas valve is sent to the switch 25 of the sensor and the microprocessor is responsive to a reply signal from the sensor on line 33 indicating the second contacts are closed for enabling the inducer fan preparatory to burner ignition. The inducer fan is enabled by a signal on line 35 which, by way of the driver transistor 37, energizes relay coil 39 and closes contacts 41.

Figure 8:
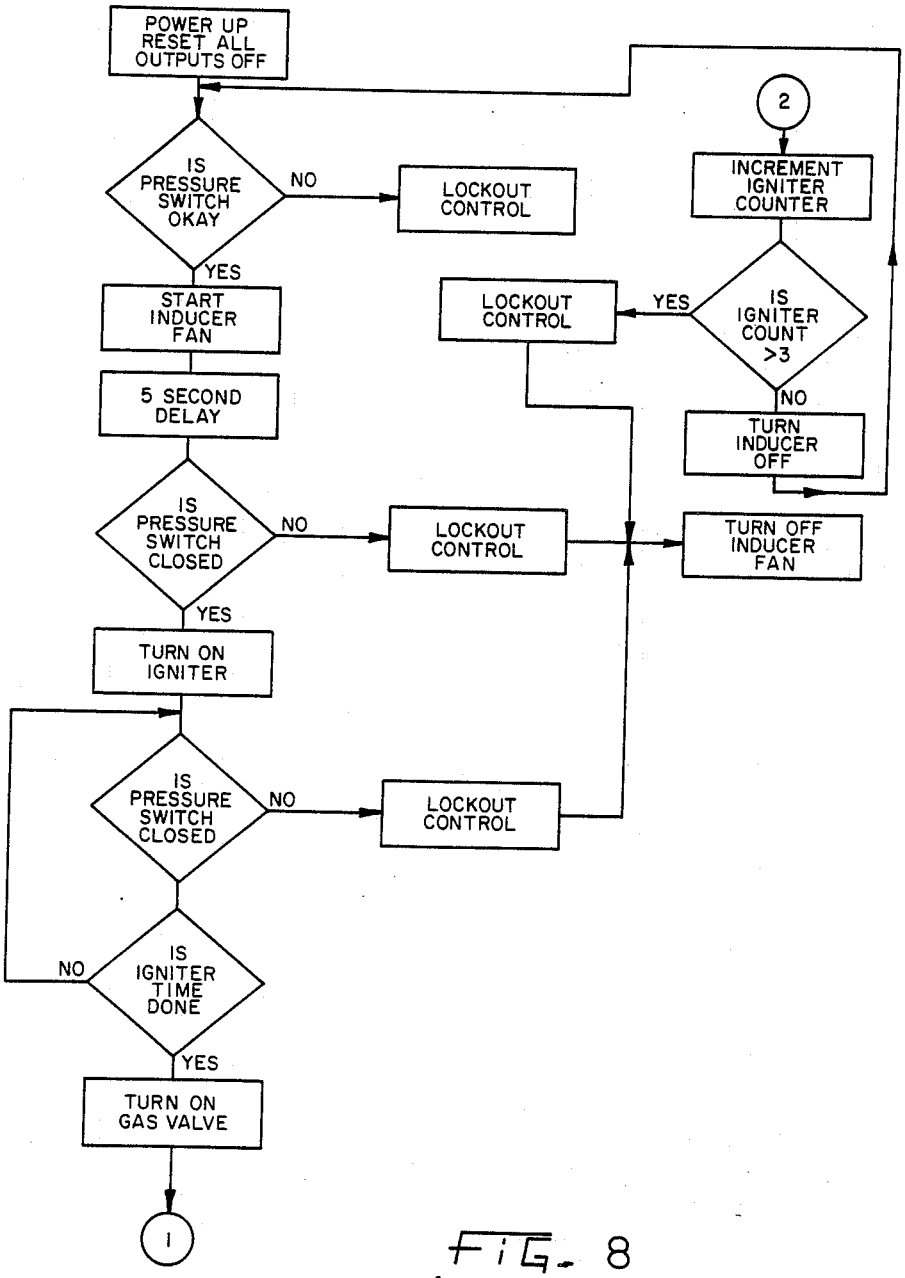

Subsequent to the enabling of the inducer fan, a signal (which again is the presence of the 24 volt alternating current signal on line 43 in the embodiment illustrated in FIG. 2) is sent to the sensor switch 25 and in response to a reply signal from the sensor by way of normally closed contacts 23 and Schmitt trigger 45 indicating the first contacts are closed, the microprocessor issues a command on line 47 to enable relay 49 for initiating burner ignition. In the illustrated embodiment, actuation of the relay 49 activates a hot surface igniter. After a preset time adequate to allow the hot surface to reach an adequate combustion temperature, the microprocessor issues a command on line 15 to enable the gas valve. The sequence of events as thus far described is illustrated in FIG. 8. During burner operation, the status of the switch 25, and, therefore, the presence of an adequate air flow, is monitored because the gas valve enabling current flows through the contacts 27 and 29. Should the switch status change, the voltage supply is interrupted thereby disabling burner operation and closing the gas valve. Thus, an indication that the first contacts are open shuts down the burner.

Figure 9:
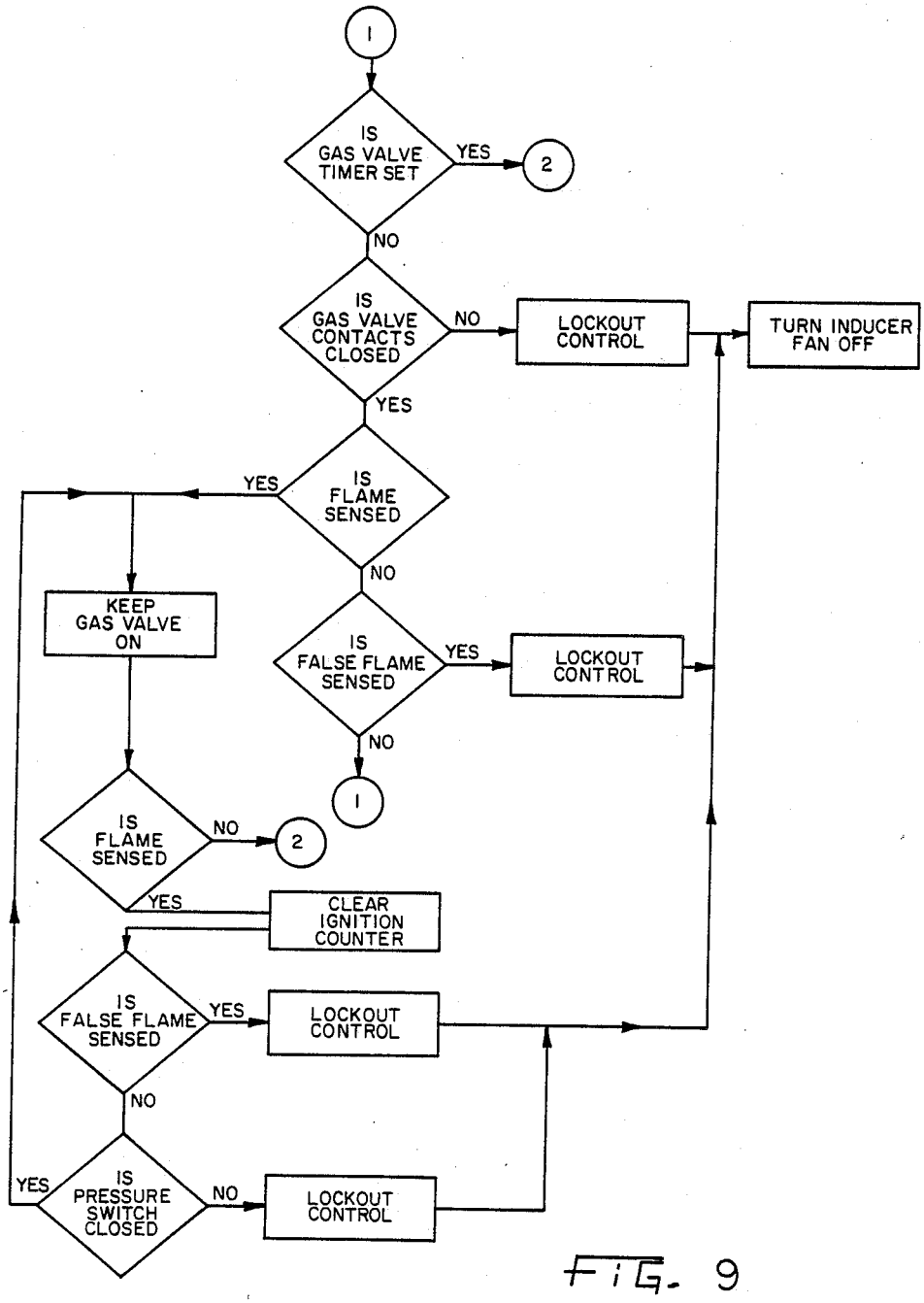

The burner control system may also include a flame sensor in the form of a probe which forms part of a flame rectification type flame sensor for sensing for the presence of a flame in the combustion chamber. During normal operation, the microprocessor sends a sequence of pulses to the flame sensor and receives back from the flame sensor the same sequence of pulses on line 51 indicating the presence of a flame. The microprocessor is also adapted to be responsive, for example, prior to the flame having been established, to the reception from the flame sensor of a sequence of pulses in the absence of any sequence having been sent for providing a fault indication and precluding ignition attempts. In the event of the sending of the sequence to the flame sensor and lack of reception back of the same sequence of pulses, the microprocessor recognizes this as a dangerous lack of flame condition and disables the gas valve control relay thus closing the gas valve. The microprocessor is also capable of sending the sequence of pulses to the flame sensor when no flame is present and, in response to the reception from the flame sensor of a sequence of pulses, providing a fault indication and precluding any ignition attempts. This flame sensing sequence is illustrated in FIG. 9 and will be more completely understood from the subsequent discussion of an analogous operation in the circuit of FIG. 1.

Figure 1A:
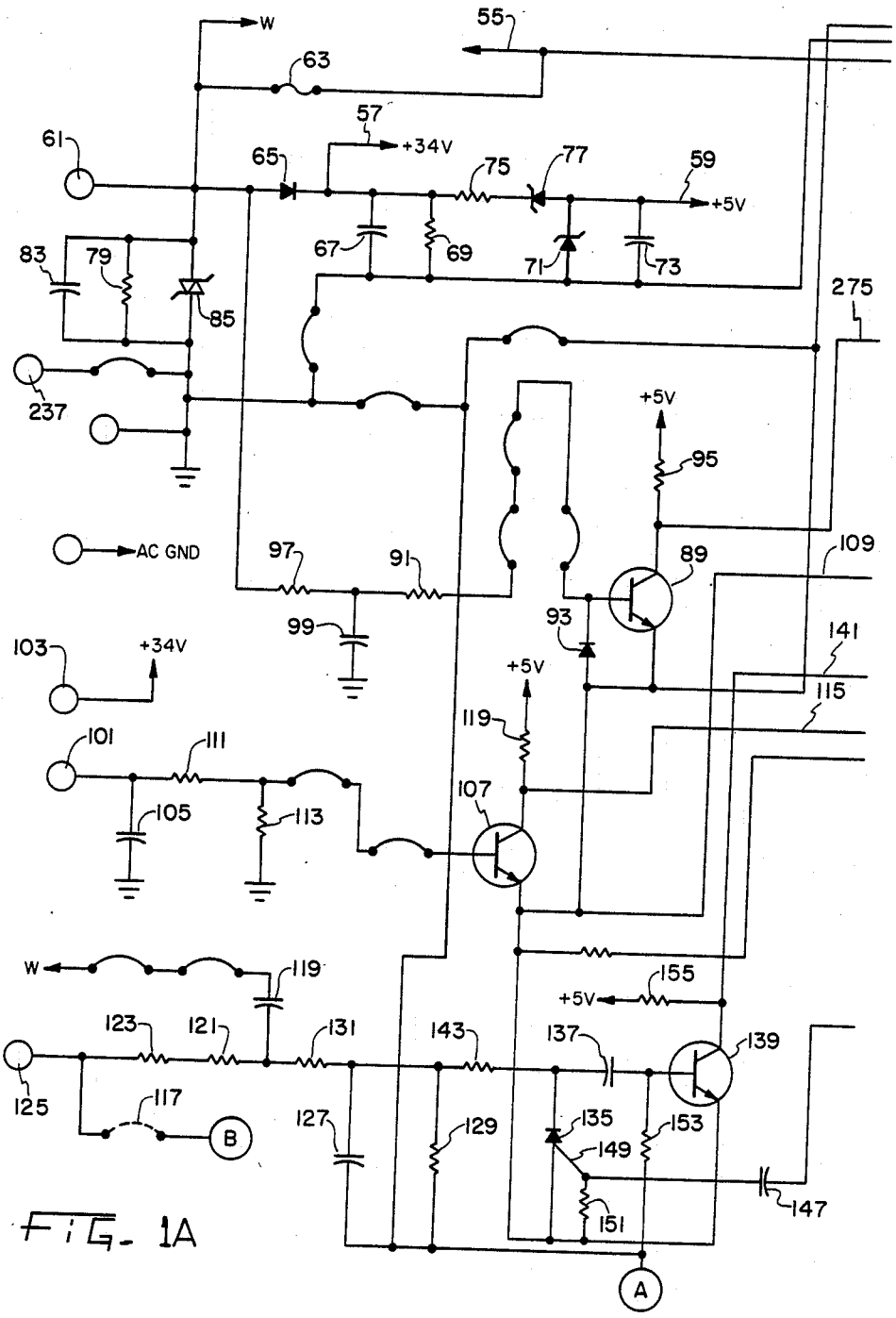
FIGS. 1A–1C, when joined, form a schematic diagram of an integrated furnace control illustrating the present invention in one form.
Figure 1B:
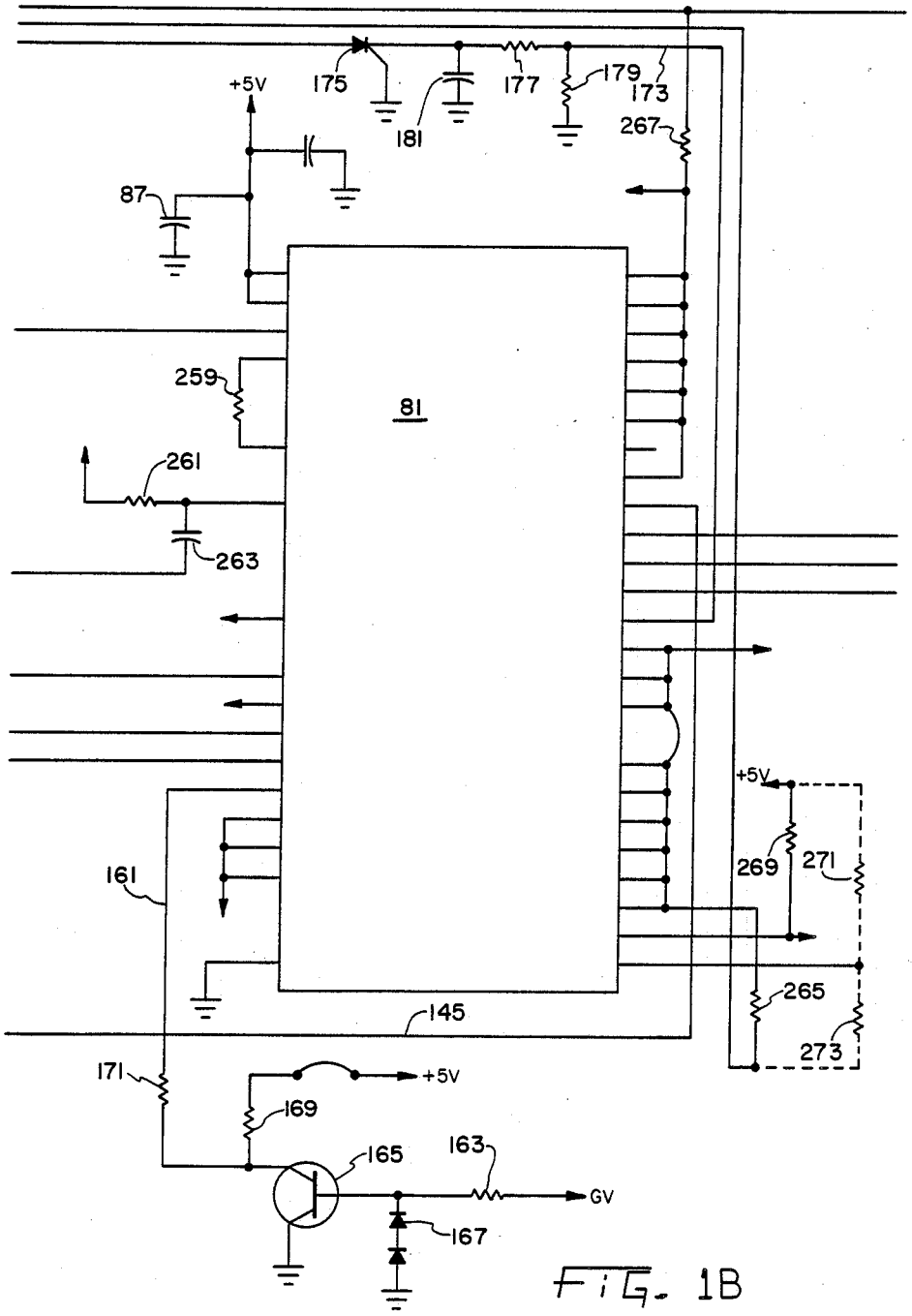
Figure 1C:
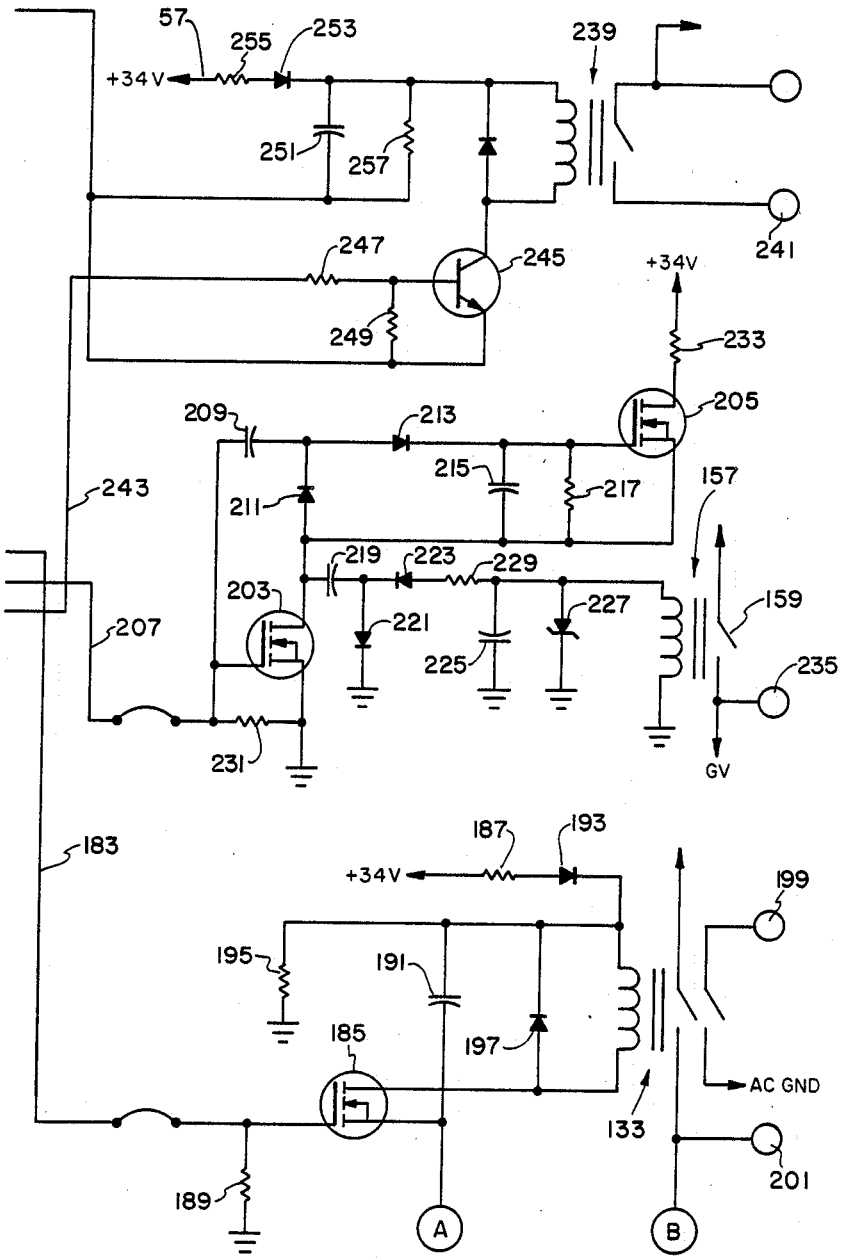

In FIG. 1, the power supply portion of the circuit receives a 24 volt alternating current as its call for heat indication from a thermostat on line 61 which appears by way of fuse 63 on line 55 and further provides a 34 volt direct current supply on line 57 and a 5 volt direct current supply on line 59. The power supply 53 of FIG. 2 was not discussed, but its operation is conventional. The applied thermostat voltage is half-wave rectified by diode 65 and the ripple reduced by capacitor 67. Resistor 69 discharges capacitor 67 when the call for heat is removed. The 5 volt line 59 is regulated by Zener diode 71 and capacitor 73 with excess voltage drop occurring across resistor 75 and Zener diode 77. If the input terminal 61 is being controlled by an electronic thermostat, this last Zener diode and a resistor 79 ensure that the microprocessor 81 is not powered by any leakage current when the system is in the off state. Such an off-state voltage will be pulled down to about 7 volts by the resistive connection to ground and the approximately 9.1 volt Zener diode 77 prevents any voltage from appearing on line 59. The capacitor 83 and metal oxide varistor 85 in parallel with resistor 79 and capacitor 87 are present to reduce any noise in the power supply voltages.

The 24 volt alternating current call for heat signal on terminal 61 provides a 60 Hertz interrupt signal to the microprocessor 81 by turning on transistor 89 during the positive half-cycle. Resistor 91 limits the base current in transistor 89 and the diode 93 prevents excessive reverse bias on the base of that transistor during the negative half-cycle. During the negative half-cycle, the resistor 95 pulls the microprocessor input up to the 5 volt supply level and transistor 89 shorts that input during positive half-cycles. The resistor 97 and capacitor 99 delay the interrupt slightly to allow similar circuitry in the gas valve sensing circuit to settle before the microprocessor 81 reads it.

A pressure switch, which confirms proper operation of the air flow inducer fan, closes when the inducer motor has created sufficient draft to activate it. The pressure switch for the circuit of FIG. 1 differs from switch 25 illustrated in FIG. 2 in that only a single set of contacts is used. When the pressure switch closes, a connection is made between terminals 101 and 103 supplying the 34 volts to terminal 101. Capacitor 105 reduces noise. Switch closure is transmitted to the microprocessor when transistor 107 conducts. Resistor 111 functions to limit the base current to transistor 107 and resistor 113 grounds the base of transistor 107 when the air pressure switch is open to ensure that the transistor is off. When the switch is closed, the transistor conducts, grounding the pressure sensor input line 115. When the switch is open, the transistor 107 is nonconducting and resistor 119 pulls the voltage on line 115 up to the 5 volt level.

The flame sensing method used is flame rectification. The microprocessor may receive flame sensing signals from a remote sensor or from the hot surface igniter element. Jumper 117 is present when the hot surface igniter is used. The numerous other unnumbered jumpers depicted in FIG. 1 are present to allow use of the same basic circuit in different versions with a minimum of changes. For example, the system may be used in an environment where an inducer fan and sensor are not required in the operation of the burner. A 24 volt alternating current signal is applied through capacitor 119, and resistors 121 and 123. If the jumper 117 is not present, a separate probe is connected to terminal 125. The capacitor 119 acts as an isolator allowing a negative direct current voltage to appear across capacitor 127 and resistor 129 when a flame is present. The flame has the characteristics of a leaky diode thereby causing the rectification. Capacitor 127 reduces the ripple in the rectified direct current while resistor 131 matches the impedance of the flame to the rest of the circuit. Resistors 121 and 123 provide isolation between the low voltage portion of the circuit and the 120 volt alternating current that is present when jumper 117 is installed and the igniter relay 133 is enabled. Resistor 129 discharges capacitor 127 when the flame is removed. The presence of a flame is sensed by the microprocessor when gate 135 is enabled to discharge capacitor 137 through the base of transistor 139 thereby applying a pulse to line 141. The gate 135 may, for example, be a programmable unijunction transistor or PUT. Depletion of the charge on capacitor 137 is limited by resistor 143. The gate 135 is turned on by a 30 hertz square wave signal from the microprocessor 81 on line 145 which is passed through the capacitor 147 as a spike at the transitions in the square wave. Each negative spike turns on the gate 135 for about 40 microseconds. The gate terminal 149 of gate 135 is pulled to ground between pulses by resistor 151. When a flame is present, there is a negative two volts across gate 135. Resistor 153 functions to keep transistor 139 off between pulses while resistor 155 pulls up the input to the microprocessor on line 141 to the 5 volt level. The pulses to gate 135 turn on the transistor 139 for about 17 microseconds. The microprocessor samples the input on line 141 before and during the pulses to make sure that component failure is not falsely recognized as a flame present signal.

The gas valve relay 157 is sensed to determine if the contacts 159 have welded or stuck in the closed position. Line 161 has a 60 Hertz square wave on if the contacts 159 are closed and a 5 volt direct current bias when the contacts are open. The sense circuit operates much the same as the interrupt discussed earlier in conjunction with the 24 volt alternating voltage call for heat signal, but without the time delay provided by the resistor 97-capacitor 99 circuit. Resistor 163 limits base current in transistor 165 during the positive half-cycle of the square wave and when that transistor is conducting and line 161 is at zero volts. Diode 167 prevents excess emitter-base voltage during the negative half-cycle when the transistor is off and the microprocessor input on line 161 is at 5 volts as supplied by resistor 169. Resistor 171 tends to reduce noise going into the microprocessor.

If the gas valve relay contacts 159 do weld in a closed position, the fuse 63 which provides power to the gas valve through those closed contacts will be blown, thus closing the gas valve in a fail-safe manner as described in greater detail in copending application Ser. No. 095,507 assigned to the assignee of the present invention, entitled GAS VALVE RELAY REDUNDANT SAFETY and filed in the name of Stephen E. Youtz on even date herewith now U.S. Pat. No. 4,828,484. This is accomplished by a microprocessor output of 5 volts on line 173 which triggers the gate of a silicon controlled rectifier 175. When on, the silicon controlled rectifier draws current from the source terminal 61 through the fuse 63 to ground which exceeds the fuse limit blowing the fuse. Gate current from the microprocessor is limited by resistor 177. Resistor 179 keeps the gate at ground potential in the absence of a signal on line 173. Capacitor 181 is present to reduce noise induced triggering.

Ignition of the burner begins when the microprocessor issues the command in the form of a 5 volt output on line 183 actuating relay 133 and applying a 120 volt alternating current to the hot surface igniter. The command turns on field effect transistor 185 supplying current to the relay coil. Resistor 187 is present to act as a voltage divider in circuit with the coil to limit the power dissipated by the coil. When the relay is intended to be off, there is no voltage on line 183 and the resistor 189 pulls the gate of 185 to ground. As an aid in enabling the relay 133, capacitor 191 is charged up to the 34 volt level by way of diode 193 with that diode helping to maintain the voltage level during low points caused by ripple. Resistor 195 drains the charge on capacitor 191 after a demand for heat voltage on line 61 has been removed to prevent any spurious enabling of the relay. Diode 197 reduces the kickback voltage which appears when 185 is turned off thus protecting the field effect transistor 185. Such use of diodes across relay coils is commonplace throughout this and its companion applications. Relay 133 has two sets of contacts, i.e., it is a DPST relay, to facilitate use of the hot surface igniter as the flame sensing element by isolating that igniter from the 120 volt source when it is not energized. The igniter element is connected to terminals 199 and 201.

The circuit for enabling the gas valve relay 157 uses a 30 to 2000 Hertz alternating current signal from the microprocessor on line 207 which alternately turns field effect transistor 203 on and off. A 1700 Hertz signal was employed in one specific implementation. This circuit is described in greater detail in copending application Ser. No. 095,507 assigned to the assignee of the present application, entitled FAIL SAFE GAS VALVE DRIVE CIRCUIT and filed in the names of Victor F. Scheele and Stephen E. Youtz on even date herewith, now U.S. Pat. No. 4,865,538. This signal on line 207 is passed through an ac-dc converter or rectifier including capacitor 209, diode 211, diode 213 and capacitor 215 to also turn field effect transistor 205 on. This provides a volt bias in the range of 4 to 20 volts between the source and gate of 205 when the alternating current signal is present on line 207. Resistor 217 is present to turn off 205 when the signal on line 207 is removed. The capacitors 209 and 215 are selected so that the signal on line 207 must be at least 600 Hertz to enable 205. Diodes 221 and 223, and capacitors 219 and 225 provide another ac-dc converter for supplying negative 12 volts to the coil of relay 157 and the Zener diode 227 functions to both regulate this voltage and to limit the power dissipated by the coil when it is turned off. Current flow through the Zener diode 227 is limited by resistor 229. Resistor 231 ensures that 203 is off when the microprocessor is not driving its gate and the current through it when it is on is limited by resistor 233. The values of resistor 233 and capacitors 219 and 225 are selected to provide efficient transfer of power to the coil of relay 157. The gas valve is connected to terminals 235 and 237, the latter being the furnace chassis.

The inducer fan relay 239 when enabled, supplies 120 volt alternating current to the fan motor connected to terminal 241. The microprocessor enables this relay 239 by providing a 5 volt signal on line 243 which turns on transistor 245. Resistor 247 limits base current in that transistor and resistor 249 ensures that it is off when the signal on line 243 is absent. The fan relay circuitry functions in much the same way as that associated with the igniter relay 133. The capacitor 251 charges up to the peak voltage on line 57 and that peak voltage is maintained during ripple by diode 253. Resistor 255 functions as a voltage divider with the coil of relay 239 to limit the power dissipated by that coil while it is enabled. Resistor 257 discharges the capacitor when 245 is off to make sure that the relay is not enabled by a spurious signal.

The microprocessor 81 provides the timing for each of the functions of the integrated control while monitoring the appropriate inputs for unsafe conditions. Resistor 259 is the oscillator resistor setting the frequency of processor operation at about 2 MHz. Resistor 261 and capacitor 263 provide a 20 microsecond delay to the reset input of the microprocessor to allow for oscillator stabilization. Resistors 265 and 267 are present to pull down unused processor inputs while resistor 269 pulls up the active low test input to the processor which is used to speed up timing sequences during factory testing. The resistors 271 and 273 are used in the alternative to select either a 4 or a 6 second ignition attempt interval.

In one particular implementation of the present invention, an eight bit, MC68HCO5C4 microprocessor having four kilobytes capacity, three tri-state programmable ports and an additional output port was used.

The algorithm for processor operation is illustrated in the flow charts of FIGS. 3–7. Reference to model 10 and model 20 in these flow charts corresponds to the positioning of the jumpers of FIG. 1 and to the particular installation. The jumpers positioned as shown in FIG. 1 correspond to the model 20. The flame sensing circuitry is designed so that any single component failure will prevent the microprocessor from receiving a signal which indicates a detected flame. The flame sense circuit is checked during a purge period for flame and if such a flame is sensed, the control will lock out. Flame failure during steady state burner operation will cause the control to execute a re-ignition cycle with a maximum of three attempts to ignite during each ignition cycle and a maximum of five re-ignition cycles for each call for heat. Each attempt for ignition begins with a call for heat followed shortly by activation of the inducer fan and then a test to see that the inducer fan is providing the required draft. If adequate draft is sensed, the hot surface igniter is energized and after sufficient time for the surface to reach ignition temperature, the gas valve is enabled.

When the thermostat closes and applies the 24 volt signal to terminal 61, the control does a power up reset which turns all outputs off and initializes all inputs. This reset also occurs after a loss of power. The 60 Hertz input on line 275 from which primary timing is clocked is also checked before the control begins its operating sequence.

Figure 4:
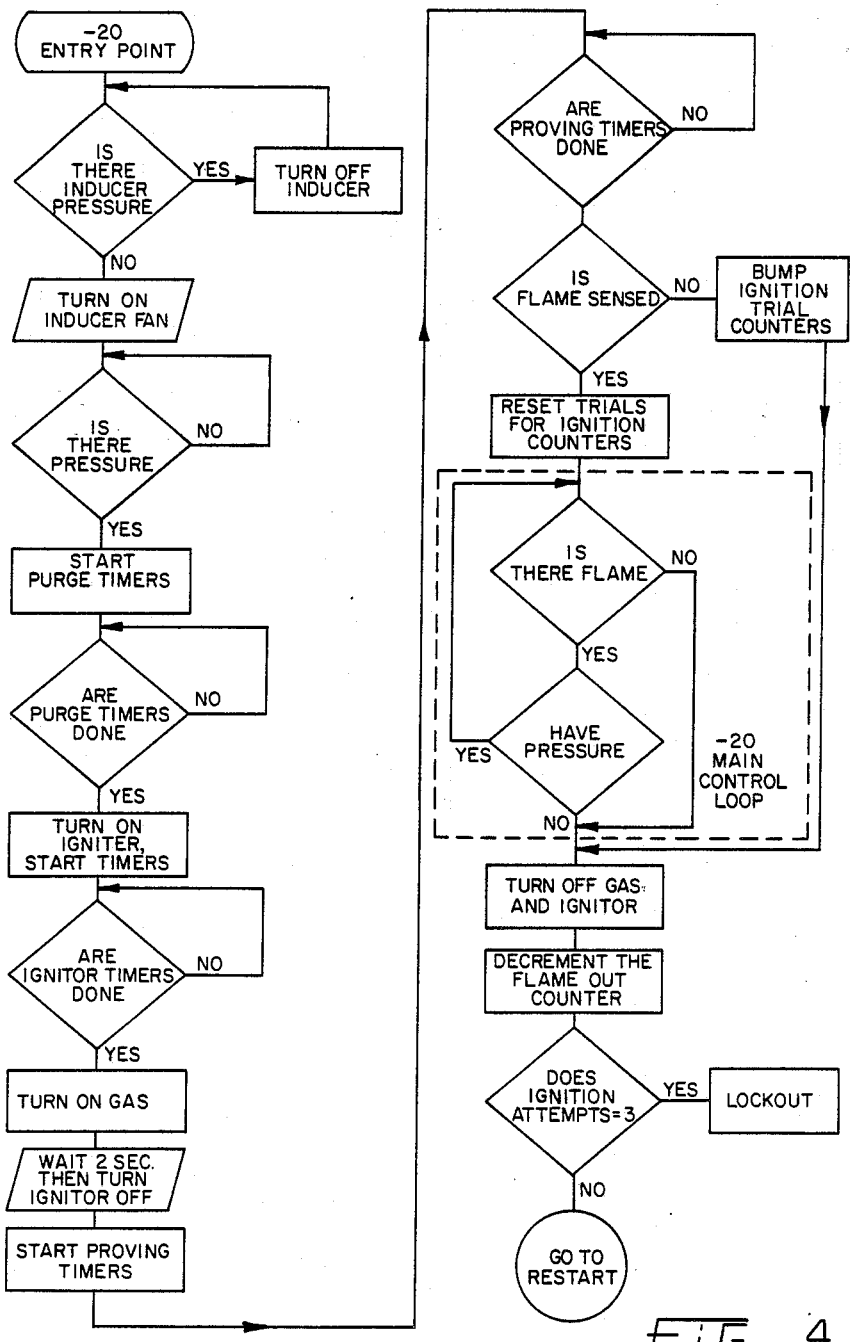
Figure 5:
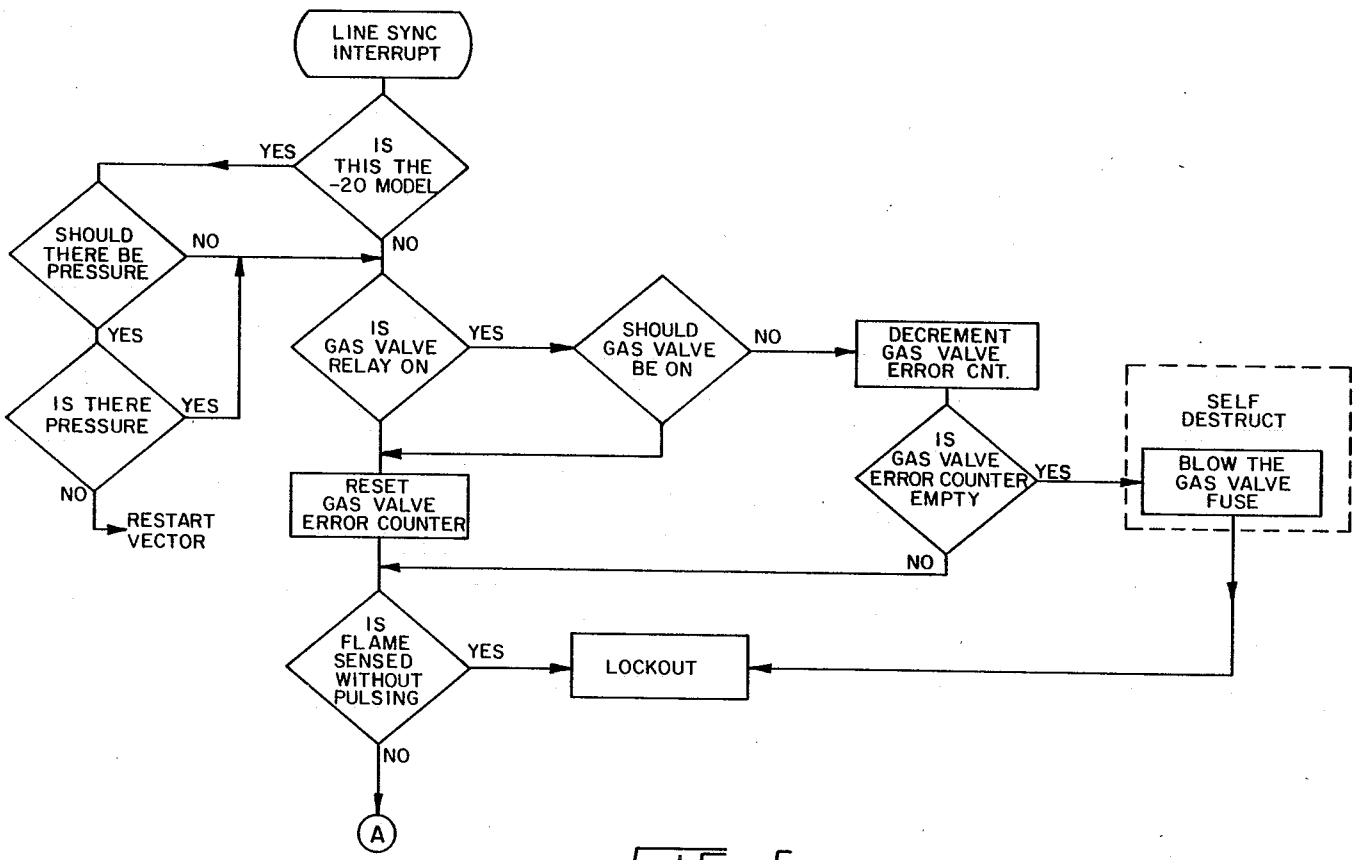
Figure 6:
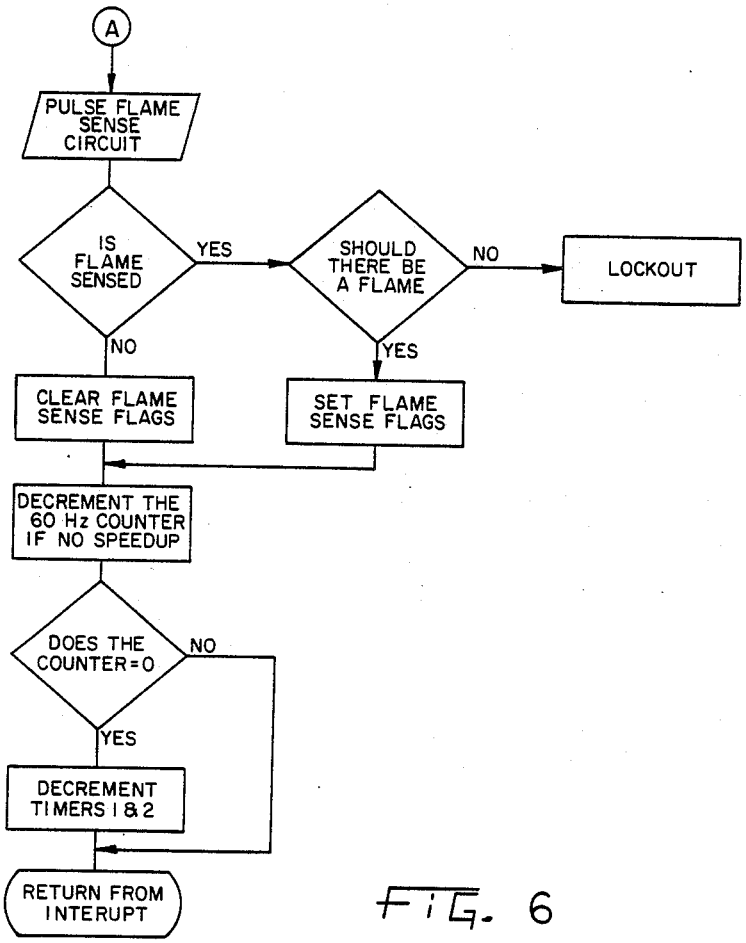
Figure 7:
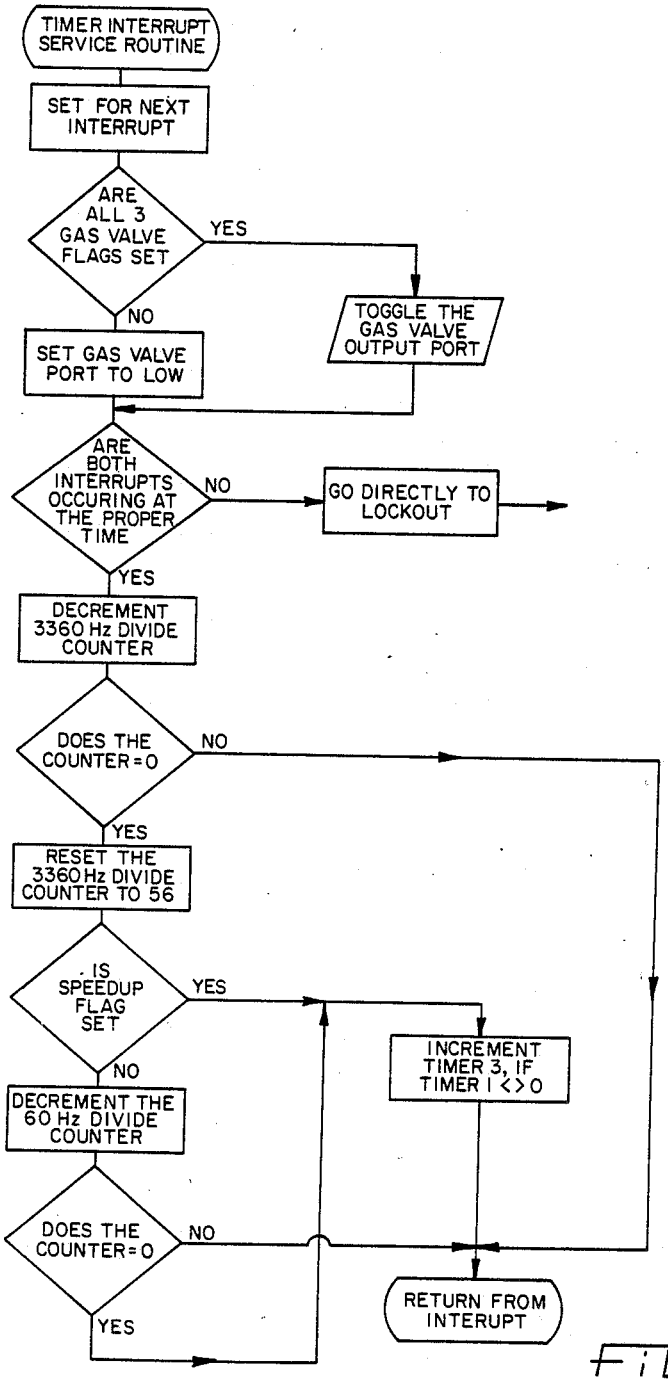

In FIG. 4, the inducer pressure is sensed both before and after the inducer fan is turned on. This gives an opportunity to be sure the status of the pressure switch has changed and to proceed with the ignition attempt only if a change in switch state has been recognized. Upon a request for heat, the inducer motor is turned on and remains on until either the thermostat demand has been satisfied or a purge is required prior to another ignition attempt. The inducer motor is turned off between ignition attempts to allow the pressure switch to open and the microprocessor will check for switch operation before the inducer is turned on again.

The igniter is timed using three separate timers, one primary timer and two secondary timers. The redundant safety features of these timers is discussed in greater detail in copending application Ser. No. 095,505 assigned to the assignee of the present invention, entitled CONTROL SYSTEM WITH TIMER REDUNDANCY and filed in the name of Stephen E. Youtz on even date herewith, now U.S. Pat. No. 4,832,594. The main timer is a down counter and is referenced to the line synchronization interrupt line 275. The first backup timer is also a down counter referenced to this same line, however, it is offset from the primary timer by one second. The second backup timer is an up counter referenced to the microprocessor internal clock. Timing is considered valid when the backup timers are within certain windows relative to the primary timer. If the timers are out of synchronization, the control goes into a lockout mode. The purge timer may operate in this same redundant manner.

The gas valve relay 157 and the igniter relay 133 are both energized during a trial for ignition. There is no sensing for a flame during this sequence. The igniter is turned off two seconds after the gas valve comes on during a try for ignition. The flame is otherwise checked thirty times per second during operation. If an ignition attempt is unsuccessful, the control will make another attempt up to a maximum of three attempts and flame failure during steady state operation will cause a re-ignition attempt.

From the foregoing disclosure, those skilled in the art will devise many adaptations, modifications and uses for the present invention beyond those herein disclosed yet within the scope of the present invention as set forth in the claims which follow.

What is claimed is:

1. An integrated digital electronics burner control for a gas burner of the type having at least one gas valve control relay operable upon command from the integrated burner control to open a gas valve and supply gas to a burner combustion chamber comprising:

a flame sensor for sensing for the presence of a flame in the combustion chamber; and means for sending a sequence of pulses to the flame sensor and for receiving back from the flame sensor the same sequence of pulses thereby normally indicating the presence of a flame.

2. The integrated burner control of claim 1 wherein the gas burner is of the type having means for igniting the gas and further comprising means responsive to the reception from the flame sensor of a sequence of pulses in the absence of any sequence having been sent for providing a fault indication and precluding ignition attempts.

3. The integrated burner control of claim 1 further comprising means responsive to the sending of the sequence to the flame sensor and lack of reception back of the same sequence of pulses for disabling the gas valve control relay and closing the gas valve.

4. The integrated burner control of claim 1 wherein the gas burner includes means for igniting the gas, and wherein the control includes means for determining no flame should be present and means for sending the sequence of pulses to the flame sensor when no flame should be present and, in response to the reception from the flame sensor of a sequence of pulses, for providing a fault indication and precluding ignition attempts.

* * * * *